US012364337B2

(12) United States Patent
Cook

(10) Patent No.: US 12,364,337 B2
(45) Date of Patent: Jul. 22, 2025

(54) FOLDABLE GLIDER CHAIR

(71) Applicant: Westfield Outdoor, Inc., Indianapolis, IN (US)

(72) Inventor: Jordan Cook, Plainfield, IN (US)

(73) Assignee: Westfield Outdoor, Inc., Indianapolis, IN (US)

( * ) Notice: Subject to any disclaimer, the term of this patent is extended or adjusted under 35 U.S.C. 154(b) by 204 days.

(21) Appl. No.: 18/228,774

(22) Filed: Aug. 1, 2023

(65) Prior Publication Data

US 2025/0040711 A1 Feb. 6, 2025

(51) Int. Cl.

| | |
|---|---|
| ***A47C 3/02*** | (2006.01) |
| ***A47C 1/03*** | (2006.01) |
| ***A47C 4/28*** | (2006.01) |
| *A47C 7/62* | (2006.01) |

(52) U.S. Cl.

CPC ..... *A47C 3/02* (2013.01); *A47C 1/0308* (2018.08); *A47C 4/28* (2013.01); *A47C 7/624* (2018.08)

(58) Field of Classification Search

CPC .. A47C 3/02; A47C 4/28; A47C 4/283; A47C 4/286; A45F 3/26

USPC ..... 297/56

See application file for complete search history.

(56) References Cited

U.S. PATENT DOCUMENTS

| | | | | |
|---|---|---|---|---|
| 2,611,419 | A | 9/1952 | McKinney et al. | |
| 2,646,838 | A | 7/1953 | Welsh | |
| 2,758,634 | A | 8/1956 | Welsh et al. | |
| 3,414,325 | A | 12/1968 | Jutila | |
| 7,322,650 | B2 | 1/2008 | Chouinard et al. | |
| 9,060,611 | B2 * | 6/2015 | Grace | A47C 3/0255 |
| 9,282,824 | B2 * | 3/2016 | Grace | A47C 3/0255 |
| 10,448,740 | B1 * | 10/2019 | Frankel | F16F 1/08 |
| 10,874,217 | B2 * | 12/2020 | Grace | A47C 4/286 |
| 10,888,163 | B2 | 1/2021 | Cook | |
| 11,006,755 | B2 * | 5/2021 | Yang | A47C 4/00 |
| 11,051,618 | B2 * | 7/2021 | Chen | A47C 3/021 |
| 11,122,903 | B2 * | 9/2021 | Sun | A47C 3/027 |
| 11,172,762 | B2 * | 11/2021 | Zhu | A47C 3/021 |
| 11,206,927 | B2 * | 12/2021 | Garrison | A47C 7/624 |
| 11,389,000 | B2 * | 7/2022 | Sun | A47C 3/0252 |
| 11,457,741 | B2 * | 10/2022 | Frankel | A47C 3/18 |
| 11,540,634 | B2 * | 1/2023 | Sun | A47C 4/283 |
| 11,607,043 | B2 * | 3/2023 | Zhu | A47C 7/70 |
| 11,812,862 | B2 * | 11/2023 | Sun | A47C 3/025 |
| 12,053,099 | B2 * | 8/2024 | Choi | A47C 4/286 |
| 2010/0171342 | A1 | 7/2010 | Chen | |
| 2013/0106145 | A1 | 5/2013 | Chen | |
| 2015/0082526 | A1 | 3/2015 | Grudzinski | |
| 2016/0206101 | A1 | 7/2016 | Grace | |

FOREIGN PATENT DOCUMENTS

| | | | |
|---|---|---|---|
| DE | 29921829 | U1 | 2/2000 |
| GB | 158988 | A | 2/1921 |

* cited by examiner

*Primary Examiner* — Rodney B White

(74) *Attorney, Agent, or Firm* — Thompson Coburn LLP

(57) ABSTRACT

A foldable glider chair has a base and gliding seat frame pivotally connected to the base to allow relative movement of the gliding seat member relative to the base in a reciprocating fashion in a direction parallel to the length edges of the seat. The base and gliding seat frame are foldable in tandem.

20 Claims, 12 Drawing Sheets

FOLDABLE GLIDER CHAIR

BACKGROUND AND SUMMARY

The present disclosure is directed to is a foldable glider chair. The foldable glider chair has a base and a gliding seat frame pivotally connected to the base to allow relative movement of the gliding seat frame relative to the base in a reciprocating fashion in a direction parallel to the length edges of the seat.

Figure 1:
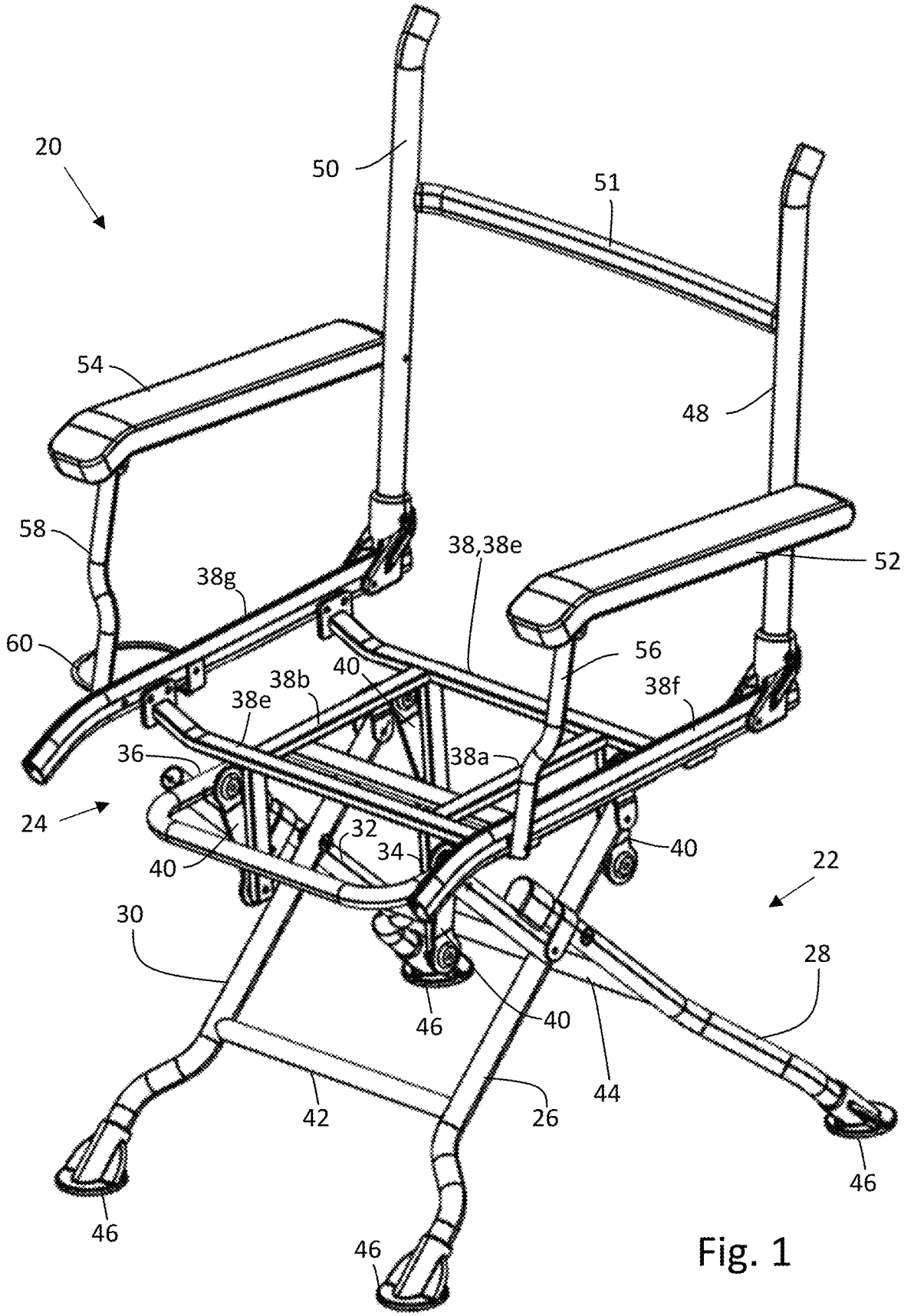
FIG. 1 is a perspective view of an exemplary foldable glider chair.

Reference numerals in the written specification and in the figures indicate corresponding items.

DETAILED DESCRIPTION

An embodiment of a foldable glider chair is shown generally by element number 20. The foldable glider chair 20 comprises a base 22 and a gliding seat frame 24.

Figure 2:
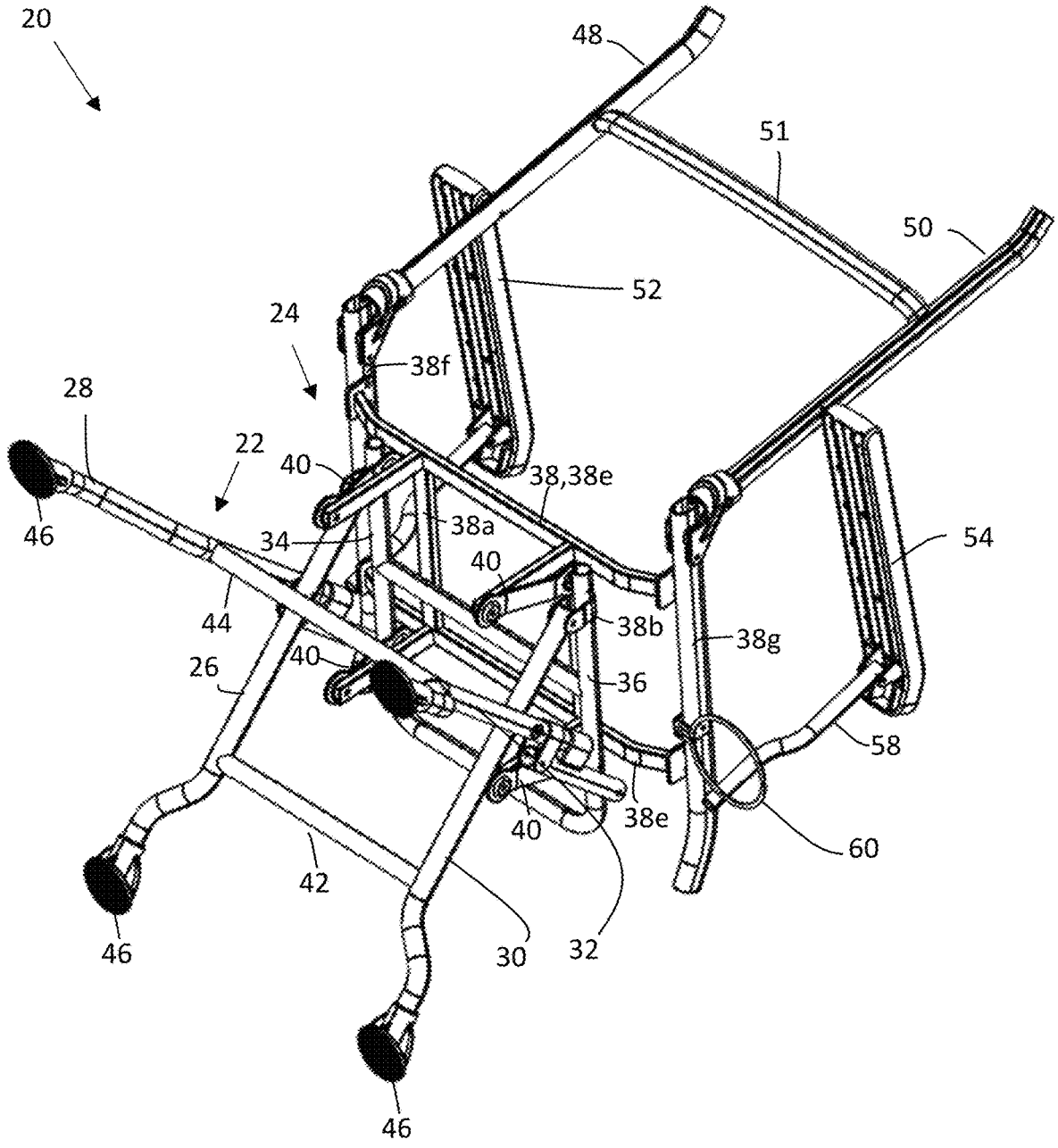
FIG. 2 is an alternate perspective view of the foldable glider chair of FIG. 1.
Figure 3:
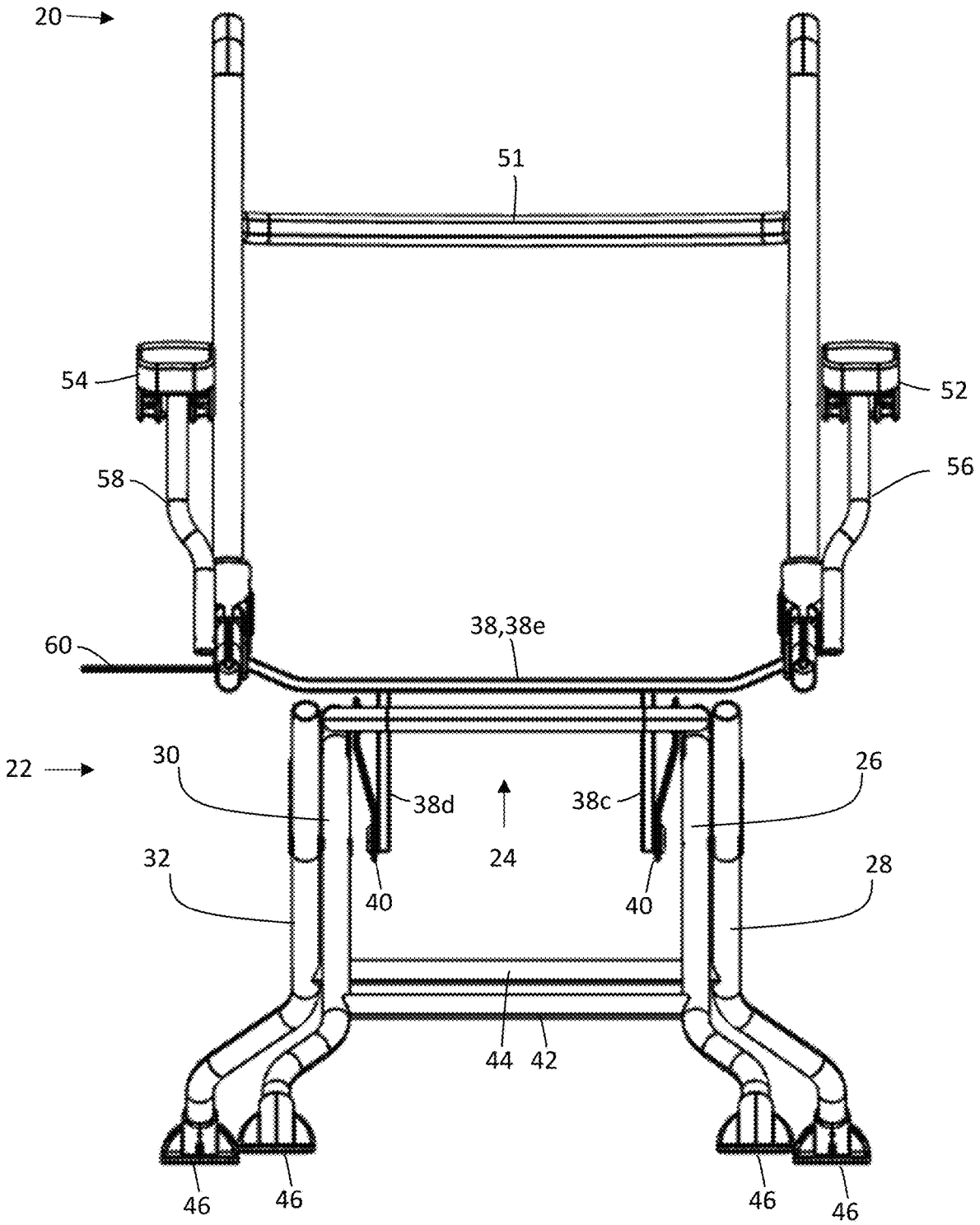
FIG. 3 is a front view of the glider chair of FIG. 1.
Figure 4:
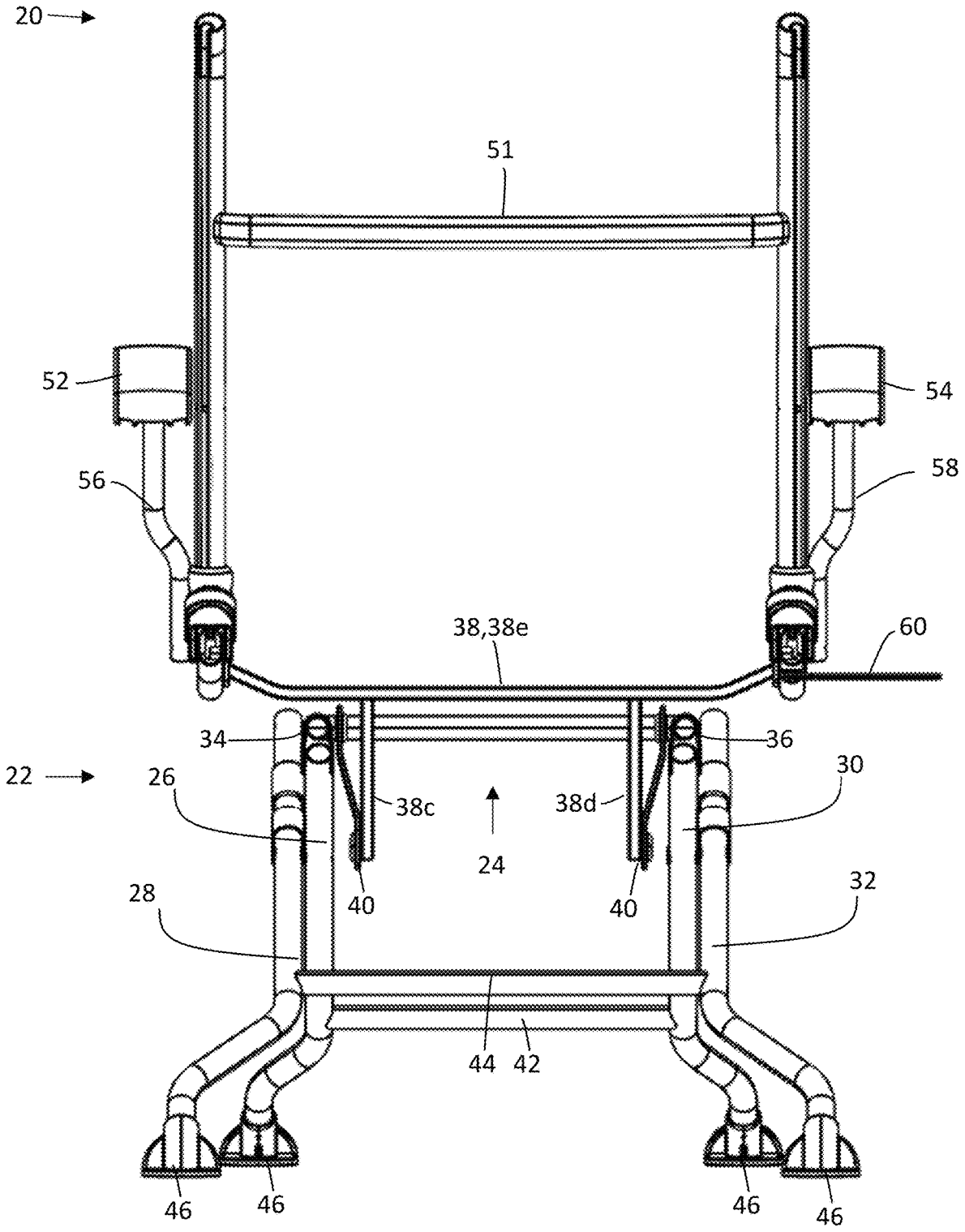
FIG. 4 is a rear view of the glider chair of FIG. 1.
Figure 5:
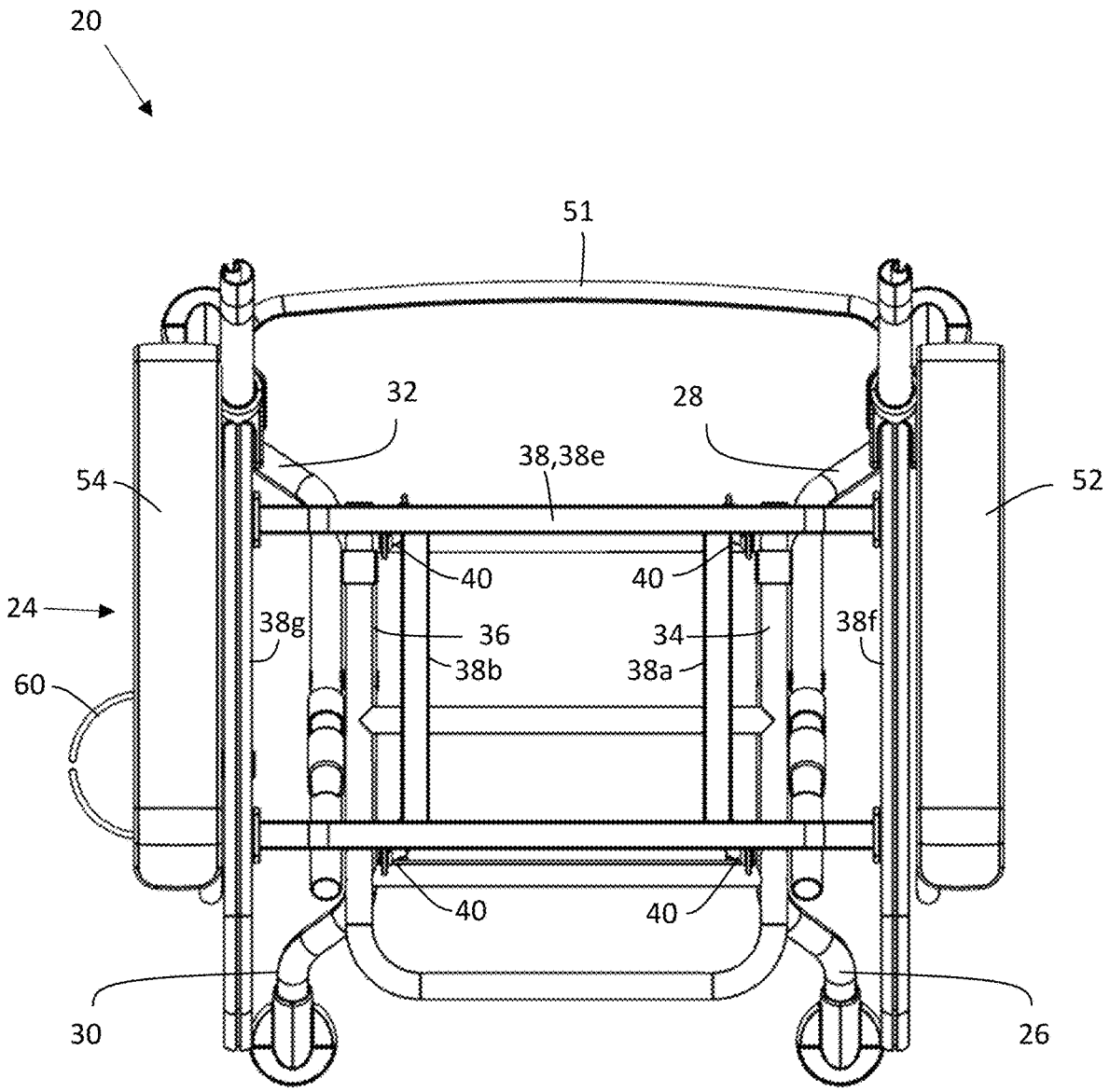
FIG. 5 is a top view of the glider chair of FIG. 1.
Figure 6:
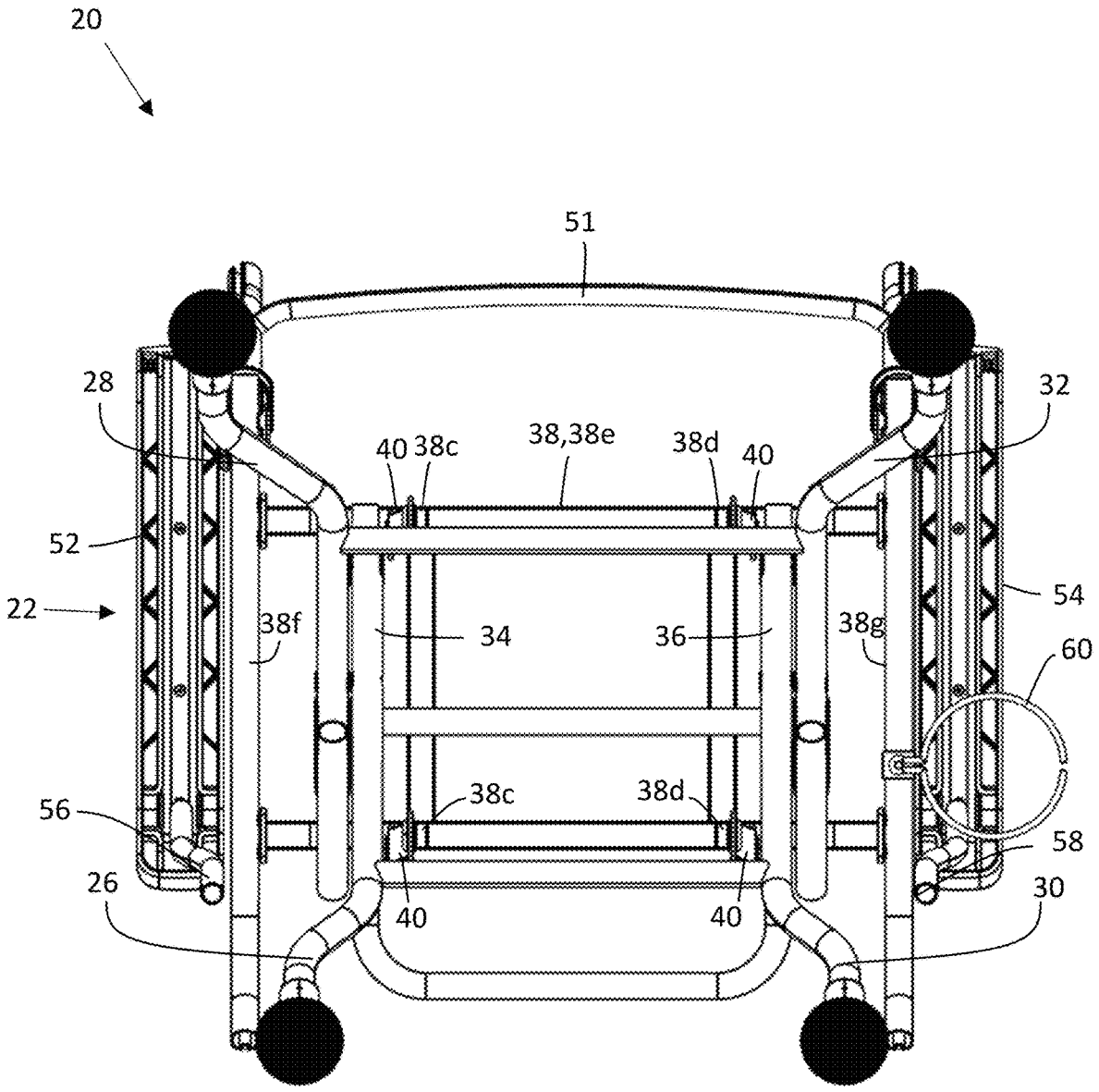
FIG. 6 is a bottom view of the glider chair of FIG. 1.
Figure 7:
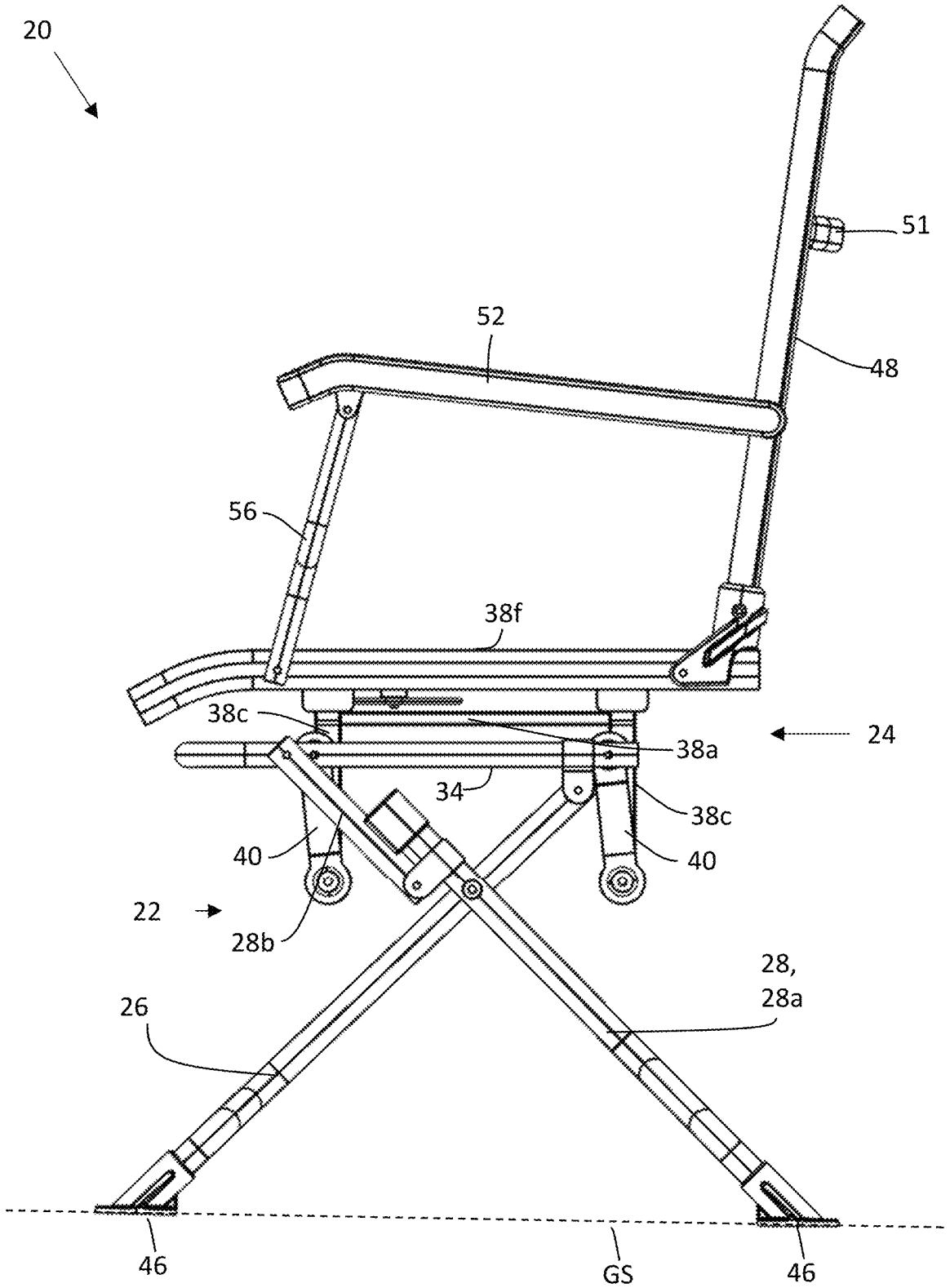
FIG. 7 is a left side view of the glider chair of FIG. 1.
Figure 8:
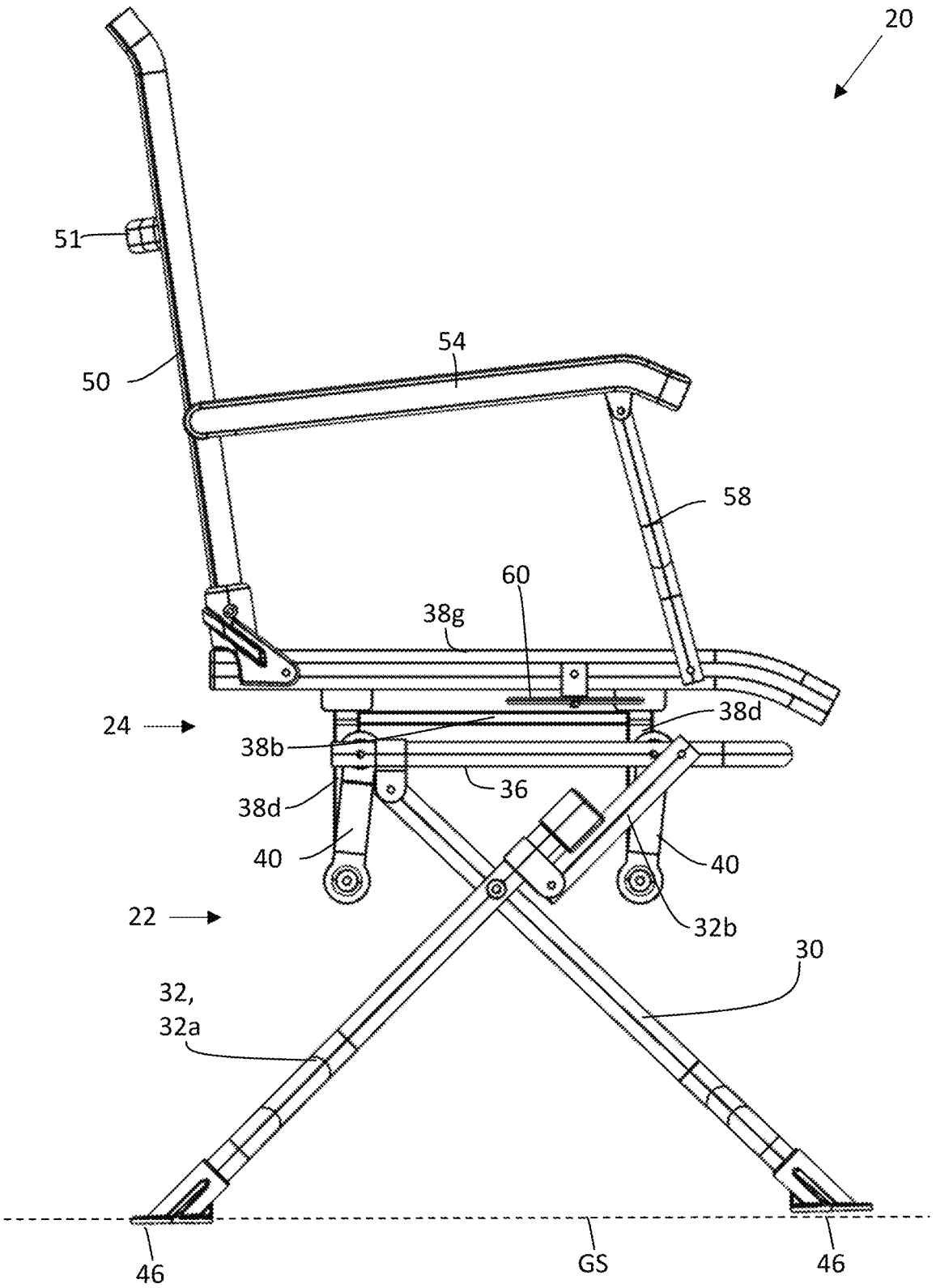
FIG. 8 is a right side view of the glider chair of FIG. 1.
Figure 9:
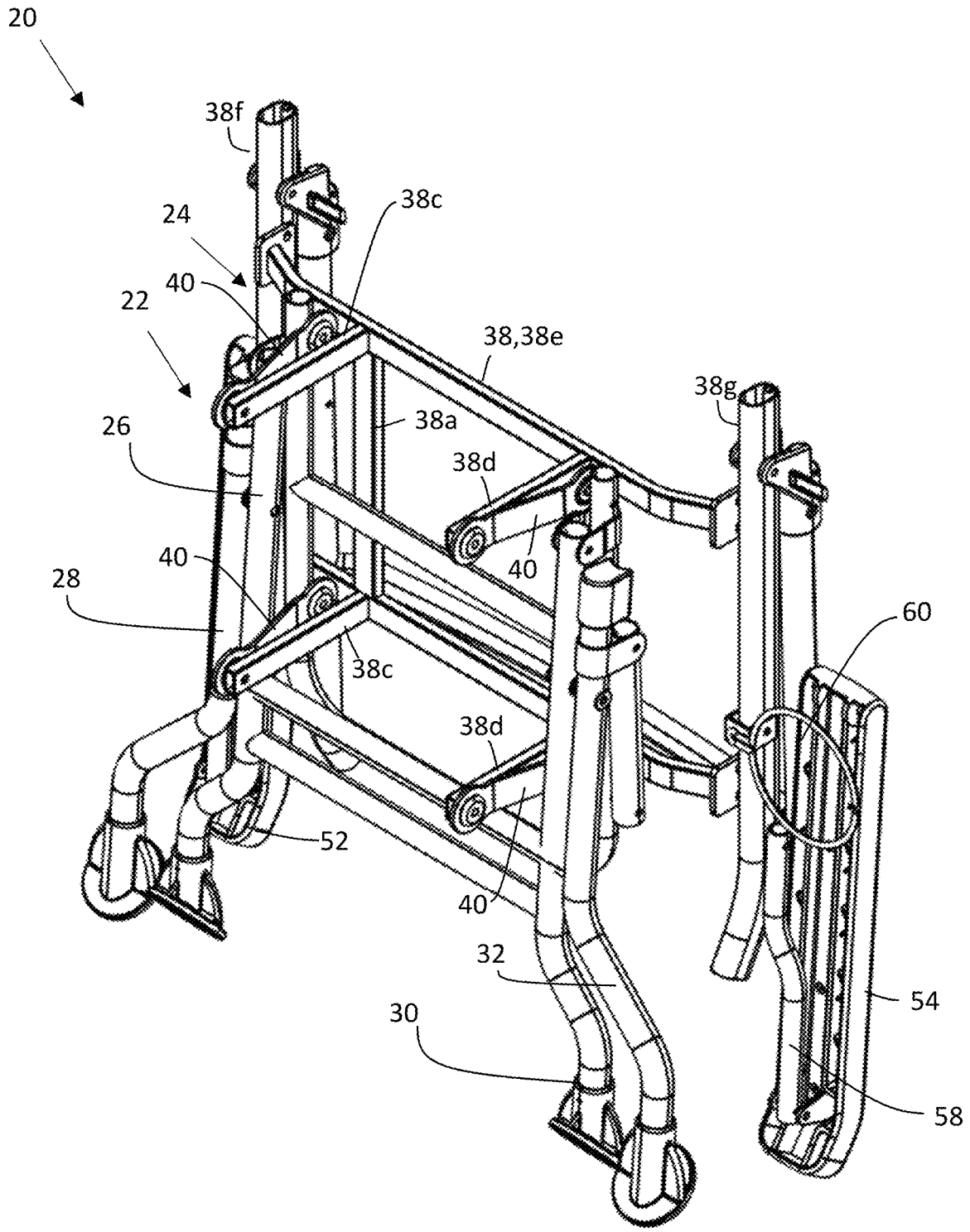
FIG. 9 is a rear, bottom perspective view of the glider chair of FIG. 1 in a collapsed position.
Figure 10:
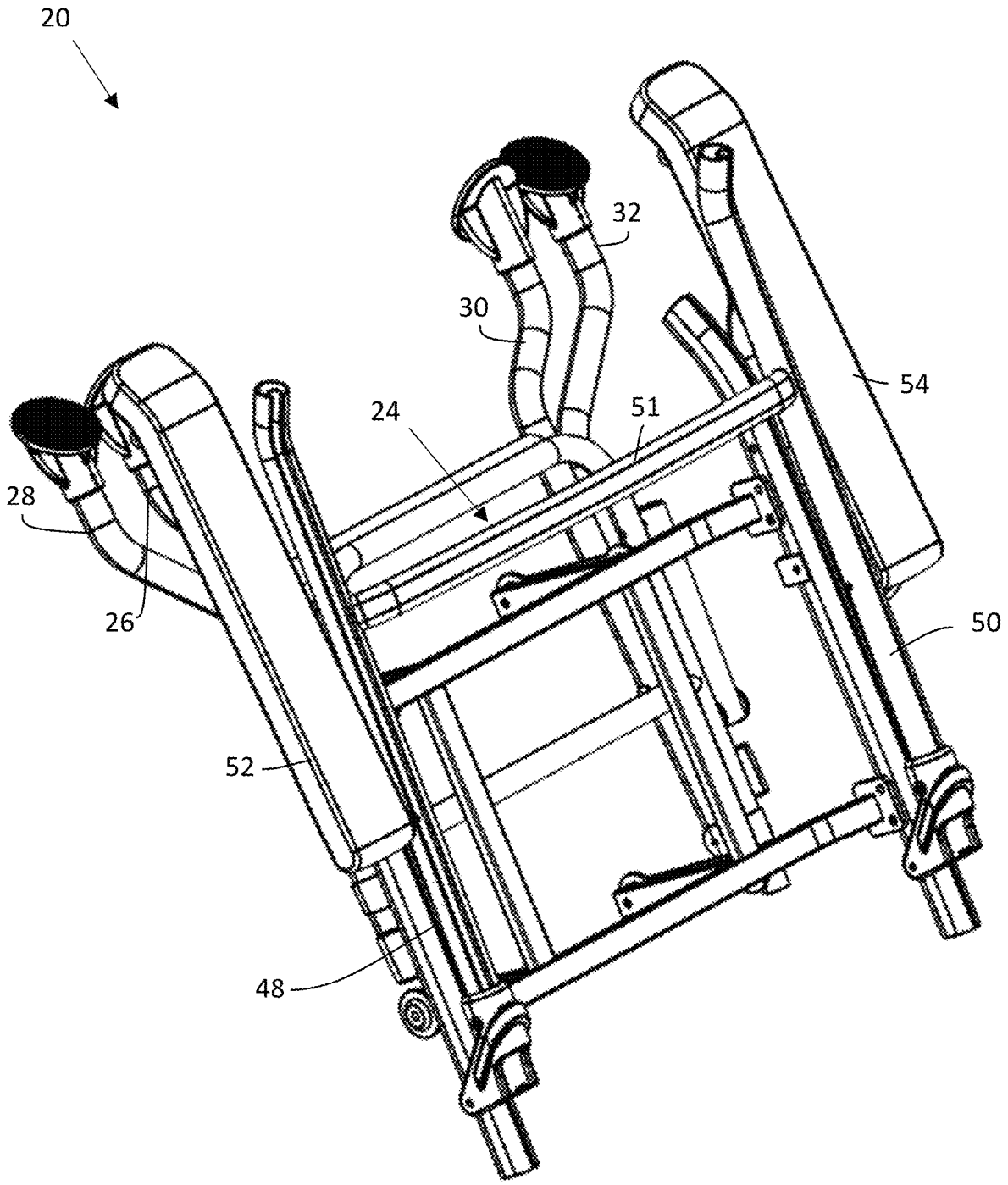
FIG. 10 is an alternate top perspective view of the glider chair of FIG. 1 in a collapsed position.
Figure 11:
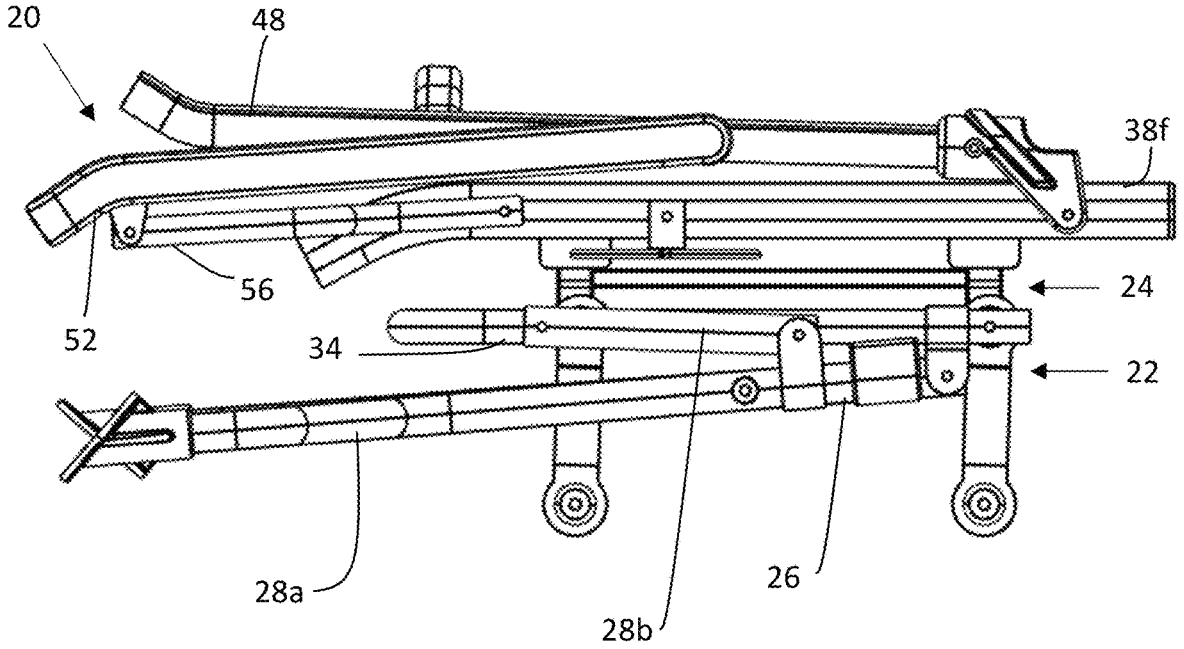
FIG. 11 is a left side view of the glider chair of FIG. 1 in a collapsed position.
Figure 12:
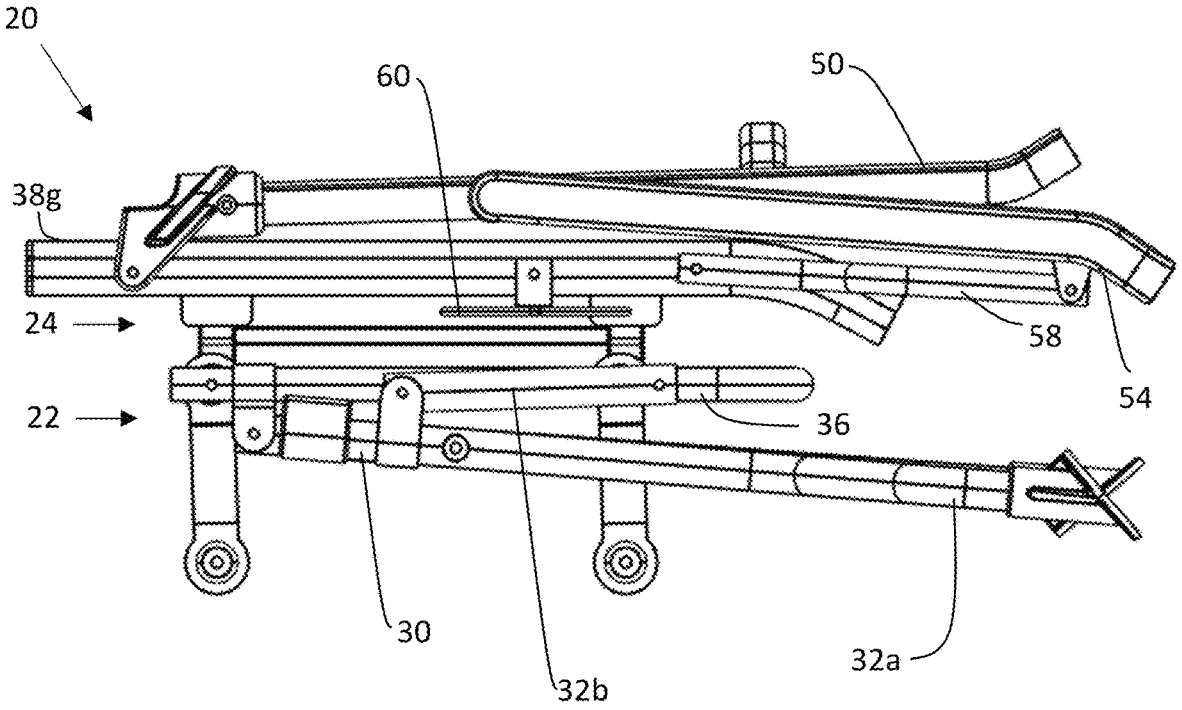
FIG. 12 is a right side view of the glider chair of FIG. 1 in a collapsed position.
Figure 13:
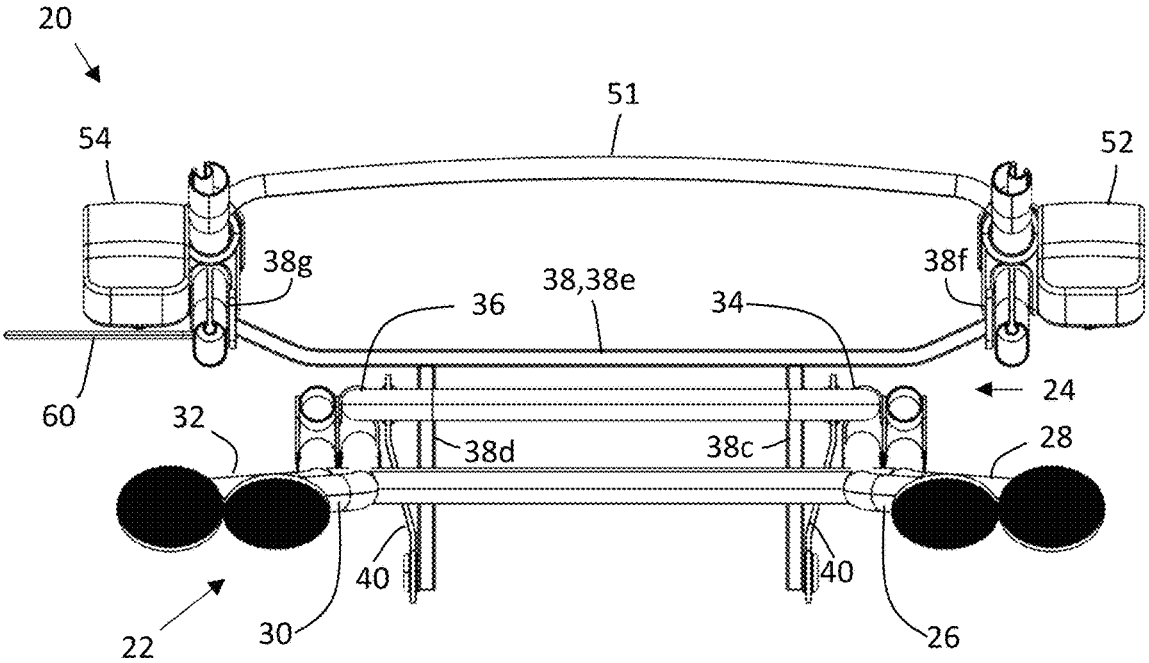
FIG. 13 is a front view of the glider chair of FIG. 1 in a collapsed position.
Figure 14:
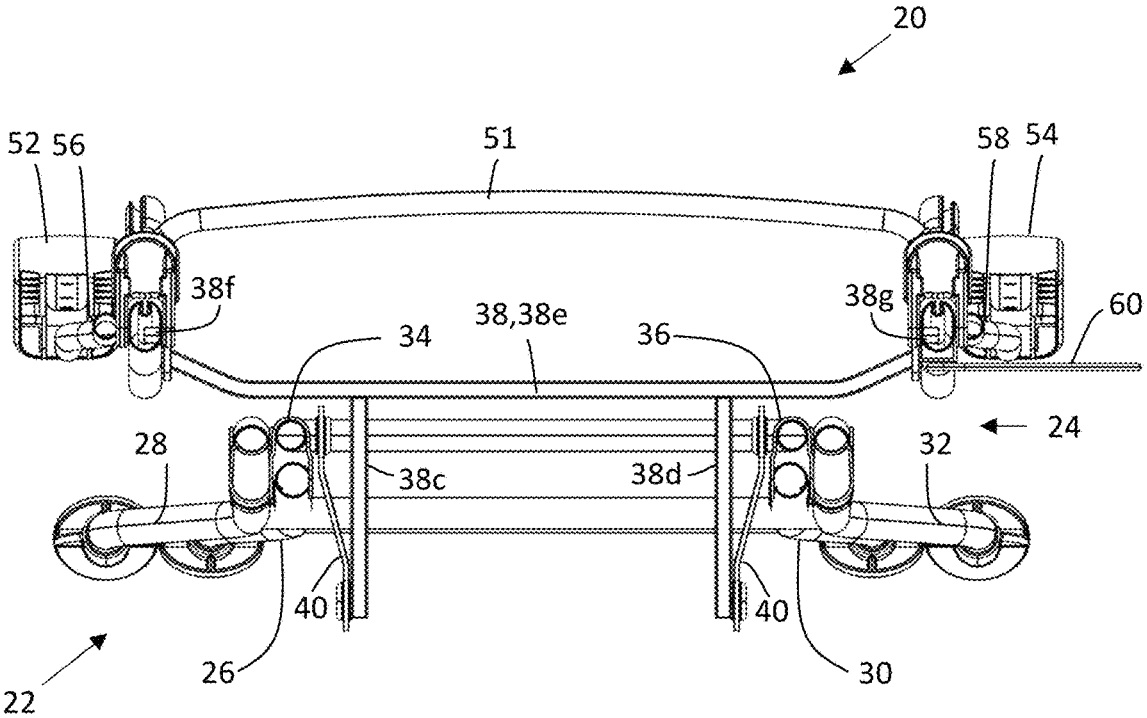
FIG. 14 is a rear view of the glider chair of FIG. 1 in a collapsed position.

The base 22 comprises first and second left legs 26,28 and first and second right legs 30,32. Not in any limiting sense, but for ease of illustration and making reference to the drawings, left is considered relative to the left hand of a user seated in the chair and right is considered relative to the right hand of a user seated in the chair. The first and second left legs 26,28 are laterally spaced across the base 22 from first and second right legs 30,32. The first left leg 26 may be pivotally connected to the second left leg 28, and the first right leg 30 may be pivotally connected to the second right leg 32. The base 22 may be movable between an expanded position (FIGS. 1-8) and a collapsed position (FIGS. 9-14). In the expanded position, the first left leg 26 may be substantially transverse to the second left leg 28, and the first right leg 30 may be substantially transverse to the second right leg 32. In the collapsed position, the first left leg 26 may be substantially parallel to the second left leg 28, and the first right leg 30 may be substantially parallel to the second right leg 32.

The base 22 may further comprise a left stationary support member 34 and a right stationary support member 36. The left and right stationary support members 34,36 may be connected together. For instance, the left and right stationary support members may be connected together to form a general U-shape or rectangular shape. The left stationary support member 34 may be operatively pivotally connected to the first left leg 26 and operatively pivotally connected to the second left leg 28. The right stationary support member 36 being operatively pivotally connected to the first right leg 30 and operatively pivotally connected to the second right leg 32.

The gliding seat frame 24 may comprise a seat support frame 38. The seat support frame 38 may have left and right carriage members 38*a*,38*b*. The left carriage member 38*a* of the seat support frame 38 may be operatively pivotally connected to the left stationary support member 34 of the base 22 by a plurality of linkages 40. Likewise, the right carriage member 38*b* of the seat support frame 38 may be operatively pivotally connected to the right stationary support member 36 of the base by a plurality of linkages 40. The left and right carriage members 38*a*, 38*b* of the seat support frame 38 may have depending projections 38*c*,38*d* that are operatively pivotally connected to the linkages 40. The seat support frame 38 may also have cross members 38*e* extending across the carriage members 38*a*,38*b* to provide structural integrity to the frame. The seat support frame may also have left and right lateral side members 38*f*,38*g* connected to the cross members 38*e* on which fabric for the seat may be mounted. The fabric for the seat may be secured to the left and right lateral side members 38*f*,38*g* in a groove formed on the left and right lateral side members. The seat frame may be constructed such that the left carriage member and left lateral side members are integral or monolithic in construction and/or structurally adjacent to each other, and the right carriage member and right lateral side members are integral or monolithic in construction and/or structurally adjacent to each other.

The second left leg 28 and the second right leg 32 may each have a primary portion 28*a*,32*a*, respectively and a secondary portion 28*b*,32*b*, respectively. Each primary portion 28*a*,32*a* may be operatively pivotally connected to the respective secondary portion 28*b*, 32*b*. Each primary portion 28*a*, 32*a* may be operatively pivotally connected to the respective first leg 26, 30, and each secondary portion 28*b*, 32*b* may be operatively pivotally connected to the respective lateral support member (i.e., the secondary portion 28*b* of the second left leg 28 may be operatively pivotally connected to the left stationary support member 34 and the secondary portion 32*b* of the second right leg 32 may be operatively pivotally connected to the right stationary support member 36).

The primary portion 28*a*, 32*a* of each second leg may be operatively pivotally connected to the respective first leg 26, 30 laterally outboard of the respective first leg. The secondary portion 28*b*,32*b* of each second leg may operatively pivotally connected to the respective stationary support member 36,34 of the base 22 laterally outboard of the respective stationary support member of the base.

The base 22 may have at least one front brace 42 connected to the first left leg 26 and the first right leg 30, and at least one rear brace 44 connected to the second right leg 28 and the second left leg 32. The front brace 42 may comprise a single member extending of the first left leg 26 and the first right leg 30, or it may comprise scissors members pivotally connected to each other and the first left leg 26 and the first right leg 30. The rear brace 44 may comprise a single member extending of the second left leg 28 and the second right leg 32, or it may comprise scissors members pivotally connected to each other and the second left leg 28 and the second right leg 32.

Each of the first and second left legs 26, 28 and first and second right legs 30, 32 may have a foot 46 adapted and configure to contact a ground surface (GS). In the alternative, the glider chair may have struts extending between the feet to support the chair on a ground surface, and in such a configuration, the braces 42,44 may be omitted.

The glider chair 20 may further comprise a left backrest member 48 and a right backrest member 50. The left backrest member 48 may be operatively pivotally connected to the left lateral side member 38*f* of the seat support frame 38, and the right backrest member 50 may be operatively pivotally connected to the right lateral side member 38*g* of the seat support frame. Fabric may extend across the backrest members 48,50. Fabric for the backrest may be secured to the left and right backrest members 48,50 in a groove formed on the left and right backrest members. One or more backrest rib members 51 may extend between the left and right backrest members 48,50 to provide additional support and structural integrity for the glider chair.

The glider chair 20 may also comprise a left armrest member 52 and a right armrest member 54. The left armrest member 52 may be operatively pivotally connected to the left lateral side member 38*f* of the seat support frame 38, for instance, with a left pivoting armrest strut 56, and the right armrest member 54 may be operatively pivotally connected to the right lateral side member 38*g* of the seat support frame 38, for instance with a right pivoting armrest strut 58. The seat support frame 38 may extend between the left and right armrest members 52,54. The left armrest member 52 may be operatively pivotally connected to the left backrest member 48 and the right armrest member 54 may be operatively connected to the right backrest member 50.

The first and second left legs 26,28 may comprise left cross leg supports, and the first and second right legs 30,32 may comprise right cross leg supports. The left cross leg supports may be laterally spaced from the right cross leg supports by the front brace 42 and the rear brace 44. As discussed above, the left cross leg supports and the right cross legs supports may be movable between the expanded position (FIGS. 1-8) and the collapsed position (FIGS. 9-14). In the expanded position, the front brace 42 may be spaced from the rear brace 44 by a first distance, and in the collapsed position, the front brace may be spaced from the rear brace by a second distance that is less than the first distance. When the left cross leg supports are in the expanded position, the primary portion 28*a* and secondary portion 28*b* of the second leg 32 are substantially parallel. When the left cross leg supports are in the collapsed position, the secondary portion 28*b* of the second leg 28 and the left stationary support member 34 are substantially parallel. Likewise, when the right cross leg supports are in the expanded position, the primary portion 32*a* and secondary portion 32*b* of the second leg 32 are substantially parallel. When the right cross leg supports are in the collapsed position, the secondary portion 32*b* of the second leg 32 and the right stationary support member 36 are substantially parallel.

The foldable glider chair 20 may further comprise a side-seat attachment 60. The side-seat attachment 60 may be operatively attached to left or right armrest members 52, 54. The side-seat attachment may comprise a cupholder, a tray, umbrella holder, pocket, or the like.

In view of the foregoing, it should be appreciated that the invention has several advantages over the prior art.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents

What is claimed is:

1. A foldable glider chair comprising:

a base comprising:

first and second left legs being laterally spaced across the base from first and second right legs, the first left leg being pivotally connected to the second left leg, the first right leg being pivotally connected to the second right leg, the base being movable between an expanded position and a collapsed position, wherein in the expanded position, the first right leg is substantially transverse to the second right leg and the first left leg is substantially transverse to the second left leg, and wherein in the collapsed position, the first right leg is substantially parallel to the second right leg and the first left leg is substantially parallel to the second left leg; and a left stationary support member, the left stationary support member being operatively pivotally connected to the first left leg and operatively pivotally connected to the second left leg;

a right stationary support member, the right stationary support member being operatively pivotally connected to the first right leg and operatively pivotally connected to the second right leg; and a gliding seat frame comprising a seat support frame having left and right carriage members;

wherein the left carriage member of the seat support frame is operatively pivotally connected to the left stationary support member by a plurality of linkages, the right carriage member of the seat support frame is operatively pivotally connected to the right stationary support member by a plurality of linkages.

2. The glider chair of claim 1 wherein the second left leg and the second right leg each have a primary portion and a secondary portion, each primary portion is operatively pivotally connected the respective secondary portion, each primary portion is operatively pivotally connected to the respective first leg, each secondary portion is operatively pivotally connected to the respective stationary support member.

3. The glider chair of claim 2 wherein the primary portion of each second leg is operatively pivotally connected to the respective first leg laterally outboard of the respective first leg.

4. The glider chair of claim 2 wherein the secondary portion of each second leg is operatively pivotally connected to the respective stationary support member laterally outboard of the respective lateral support member.

5. The glider chair of claim 1 wherein the base has at least one front brace connected to the first right leg and the first left leg, and at least one rear brace connected to the second right leg and the second left leg.

6. The glider chair of claim 1 wherein the left and right stationary support members are connected together.

7. The glider chair of claim 1 wherein the gliding seat frame further comprises a left lateral side member of the seat support frame outboard of the left carriage member, and a right lateral side member of the seat support frame outboard of the right carriage member.

8. The glider chair of claim 7 further comprising a left backrest member and a right backrest member, the left backrest member being operatively pivotally connected to, the left lateral side member of the seat support frame, the right backrest member being operatively pivotally connected to the right lateral side member of the seat support frame.

9. The glider chair of claim 8 further comprising a right armrest member and a left armrest member, the left armrest member being operatively pivotally connected to the left lateral side member of the seat support frame, the right armrest member being operatively pivotally connected to the right lateral side member of the seat support frame such that the seat support frame extends between the left and right armrest members.

10. The glider chair of claim 9 wherein the left armrest member is operatively pivotally connected to the left backrest member and the right armrest member is operatively connected to the right backrest member.

11. A foldable glider chair comprising:

right cross leg supports and left cross leg supports, the right cross leg supports being laterally spaced from the left cross supports by at least one front brace and at least one rear brace, the right cross leg supports and the left cross legs supports being movable between an expanded position and a collapsed position, wherein in the expanded position, the at least one front brace is spaced from the at least one rear brace by a first distance, and wherein in the collapsed position, the at least one front brace is spaced from the at least one rear brace by a second distance, the second distance being less than the first distance;

a left stationary support member, the left stationary support member being operatively pivotally connected to the left cross leg supports;

a right stationary support member, the right stationary support member being operatively pivotally connected to the right cross leg supports; and a seat support frame having left and right carriage members, the left carriage member of the seat support frame being operatively pivotally connected to the left stationary support member by a plurality of linkages, the right carriage member of the seat support frame being operatively pivotally connected to the right stationary support member by a plurality of linkages.

12. The glider chair of claim 11 wherein the left cross leg supports comprise first and second legs, the second leg has a primary portion and a secondary portion, the primary portion is operatively pivotally connected the secondary portion, the primary portion is operatively pivotally connected to the first leg, the secondary portion is operatively pivotally connected to the left stationary support member.

13. The glider chair of claim 12, wherein when the left cross leg supports are in the expanded position, the primary portion and secondary portion of the second leg are substantially parallel; and wherein when the left cross leg supports are in the collapsed position, the secondary portion of the second leg and the left stationary support member are substantially parallel.

14. The glider chair of claim 11 wherein the right cross leg supports comprise first and second legs, the second leg has a primary portion and a secondary portion, the primary portion is operatively pivotally connected the secondary portion, the primary portion is operatively pivotally connected to the first leg, the secondary portion is operatively pivotally connected to the right stationary support member.

15. The glider chair of claim 14, wherein when the right cross leg supports are in the expanded position, the primary portion and secondary portion of the second leg are substantially parallel; and wherein when the right cross leg supports are in the collapsed position, the secondary portion of the second leg and the right stationary support member are substantially parallel.

16. The glider chair of claim 11 wherein each of the left cross leg supports and each of the right cross leg supports has a foot adapted and configure to contact a ground surface.

17. The glider chair of claim 11 further comprising a left lateral side member of the seat support frame outboard of the left carriage member, and a right lateral side member of the seat support frame outboard of the right carriage member.

18. The glider chair of claim 17 further comprising a right armrest member and a left armrest member, the left armrest member being operatively pivotally connected to a left lateral side member of the seat support frame outboard of the left carriage member, the right armrest member being operatively pivotally connected to a right lateral side member of the seat support frame outboard of the right carriage member.

19. The glider chair of claim 18 further comprising a left backrest member and a right backrest member, the left backrest member being operatively pivotally connected to the left lateral side member of the seat support frame, the right backrest member being operatively pivotally connected to the right lateral side member of the seat support frame.

20. The glider chair of claim 19 wherein the left armrest member is operatively pivotally connected to the left backrest member and the right armrest member is operatively connected to the right backrest member.

* * * * *